United States Patent [19]

Pinnekamp

[11] Patent Number: 4,633,049

[45] Date of Patent: Dec. 30, 1986

[54] GAS-BLAST SWITCH

[75] Inventor: Friedrich Pinnekamp, Siggenthal-Station, Switzerland

[73] Assignee: BBC Brown, Boveri & Company, Limited, Baden, Switzerland

[21] Appl. No.: 775,402

[22] Filed: Sep. 12, 1985

[30] Foreign Application Priority Data

Sep. 20, 1984 [CH] Switzerland ..... 4502/84

[51] Int. Cl.[4] ..... H01H 33/88

[52] U.S. Cl. ..... 200/148 A; 200/148 R

[58] Field of Search ..... 200/148 A, 148 R

[56] References Cited

U.S. PATENT DOCUMENTS 4,368,367 1/1983 Roth et al. ..... 200/148 A 4,486,632 12/1984 Niemeyer et al. ..... 200/148 A

*Primary Examiner*—Robert S. Macon

*Attorney, Agent, or Firm*—Burns, Doane, Swecker & Mathis

[57] ABSTRACT

The gas-blast switch preferably suitable for the switching of medium voltage contains two switch pieces (2, 3), which are movable relative to one another in a housing (1), filled with insulating gas, and define an arc-quenching zone (4) during switch-off. Moreover, the arc-quenching zone (4) is defined by an insulating body (8) in which an annular channel (15) is recessed. The annular channel (15) connects the arc-quenching zone (4) with a chamber for the storage of heated-up insulating gas. Additionally compressed insulating gas can be fed to this storage chamber (9) from a compression chamber (10) of a compression device which is actuated during switch-off. In this switch, the switch-off capacity is to be increased by improving the quality of the insulating gas located in the storage chamber (9). This is achieved in that the compression chamber (10) and the storage chamber (9) are connected to one another via a flow narrow point (18). The flow narrow point (18) forces a free jet (19) to form which is composed of cool insulating gas and is directed into the storage chamber (9). This free jet (18) sucks heated-up insulating gas out of the arc-quenching zone (4) and mixes this insulating gas turbulently with the cool insulating gas contained in it, by which means rich insulating gas which is under excess pressure flows into the storage chamber (9).

5 Claims, 1 Drawing Figure

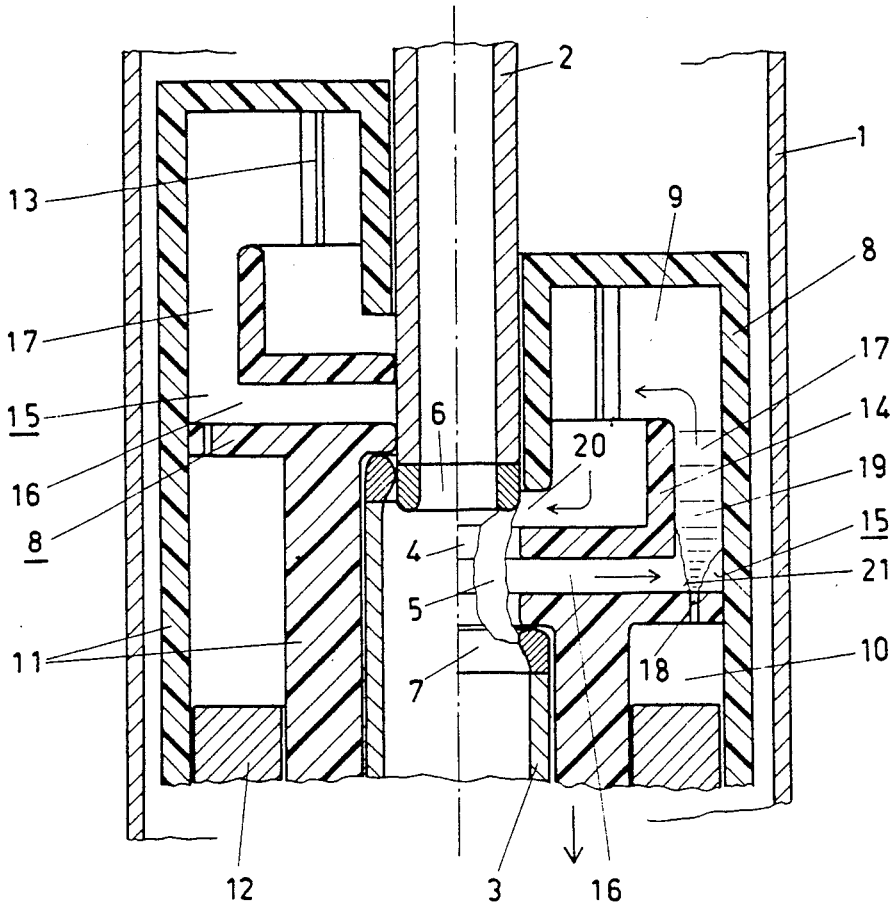
2
1
13
9
8
17
17
15
6
14
20
19
16
15
8
4
21
5
11
18
10
7
12
3
16

GAS-BLAST SWITCH

The invention is based on a gas-blast switch according to the preamble of claim 1.

With this preamble, the invention relates to a prior art as it is described in the U.S. Pat. No. 4,139,752. In the known switch, insulating gas which is heated up by the switch arc during switch-off is led into a storage chamber. When the current to be cut off approaches the current zero passage, the stored gas is conducted via an annular channel into the arc-quenching zone, located between the open switch pieces, so as to herewith blow the switch arc. For the purpose of improving the blow mechanism and thus the switch-off capacity of the switch, the storage chamber is connected via a non-return valve to the compression chamber of a compression device for insulating gas actuated during switch-off. In this way, although a high pressure build up in the storage chamber is achieved even under low currents, the quenching properties of the stored insulating gas are not optimum because of its high temperature.

The invention, as characterised in claim 1, achieves the object of particularizing a gas-blast switch of the generic type in which the switch-off capacity is essentially increased by improving the quality of the stored gas.

The object is achieved in conjunction with the features of the preamble according to the characterising part of claim 1.

Characteristics and advantages of the invention are described in greater detail below with reference to an illustrative embodiment not restricting the invention and shown in the drawing.

In the drawing, the single FIGURE shows a plan view of an axially sectioned embodiment of the gas-blast switch according to the invention, with the switch-on condition being shown in the left-hand half and the condition during switch-off being shown in the right-hand half.

In the FIGURE, 1 designates a housing made essentially in the shape of a hollow cylinder. This housing is filled with an insulating gas, such as, for example, sulfur hexafluoride of a few bar pressure. The housing 1 contains two switch pieces 2 and 3 which are movable relative to one another along an axis, are in engagement with one another in the switch-on condition of the gas-blast switch (left-hand half of the FIGURE) and, during switch-off (right-hand half of the FIGURE), define an arc-quenching zone 4 in which a switch arc 5 burns. Both switch pieces 2 and 3 are made resistant to burning off at the ends facing towards one another and have at this location gas inlet openings 6 and 7. Downstream, the switch pieces 2 and 3 have gas outlet openings which cannot be seen in the FIGURE. The gas inlet opening 7 of the switch piece 3 is of such a size that the switch piece 2, which is made stationary, can enter into this opening during switch-on and then forms an approximately gas-tight switch piece overlap with the movably made switch piece 3. Both switch pieces 2 and 3 are connected in electrically conducting manner with supply terminals (not shown in the FIGURE) led into the housing 1.

Both switch pieces 2 and 3 are surrounded by an insulating body 8 made of an arc-resistant material such as, for example, polytetrafluoroethylene. This insulating body 8 is rigidly connected to the movable switch piece 3 and has an upper annular opening which, in the switch-on condition, is penetrated by the stationary switch piece 2. Moreover, two chambers annularly surrounding the switch pieces 2 and 3 are recessed in the insulating body 8. One of these two chambers is a storage chamber 9. This chamber is predominantly used for storing gas which is heated up by the arc 5 during switch-off. The other of these two chambers is a compression chamber 10 of a compression device having a movable, annular cylinder 11 and a stationary annular piston 12.

Moreover, an annular dividing wall 14 fixed on the insulating body 8 by means of webs 13 and made of insulating material which is resistant to burn-off is located inside the insulating body 8. This wall, together with the insulating body 8, defines an annular channel 15 made with a bend. A partial piece 16 of this annular channel extends essentially perpendicularly to the switch piece axis and, during switch-off, connects the arc-quenching zone 4 with a second partial piece 17 of the annular channel 15, which partial piece 17, in turn, extends essentially in the axial direction and connects the partial piece 16 with the storage chamber 9.

The annular channel 15 and the compression chamber 10 are connected with one another via an annular flow narrow point 18. The flow narrow point has a contour which, when a compression pressure arises in the compression chamber 10, forms a free jet 19 directed into the partial piece 17 of the annular channel 15.

The dividing wall 14, together with the insulating body 8, defines a further annular channel 20 which, during switch-off, connects the storage chamber 9 with the arc-quenching zone 4. The opening of this annular channel towards the storage chamber 9 is made axially off set in the insulating body 8, relative to the corresponding opening of the annular channel 15, in the direction of the stationary switch piece 2.

The mode of operation of the gas-blast switch according to the invention is as follows:

During switch-off, the movable switch piece 3 and thus the insulating body 8 is moved downwards in the direction of the arrows. In this connection, insulating gas is pre-compressed in the compression chamber 10 during a phase essentially determined by the duration of the overlapping of the switch pieces. During this procedure, the free jet 19 guided in the partial piece 17 of the ring channel 15 develops from cool insulating gas, which free jet 19, with its turbulent boundary layer 21 and the dividing wall 14, forms a separation between the partial pieces 16 and 17 of the annular channel 15. The free jet 19 produces a vacuum in the partial piece 16 of the annular channel 15 and an excess pressure in the partial piece 17. In this connection, the pressure difference between the vacuum and the excess pressure is particularly pronounced if the two partial pieces 16 and 17 are located approximately perpendicular to one another. Mass particles located in the partial piece 16 are therefore drawn off through the boundary layer 21 and fed to the storage chamber 9 by the forming of an excess pressure. Such mass particles develop as a result of the insulating gas heated up by the arc 5 after the separation of the switch pieces. This heated-up insulating gas is fed to the partial piece 16 of the annular channel 15 by the suction action of the free jet 19 on the one hand and by the heating mechanism of the arc 5 on the other hand. In the boundary layer 21, the heated-up insulating gas is turbulently mixed with the cool insulating gas of the free jet 19. The mixed gas is then delivered into the storage chamber 9 by the forming of the excess pressure.

When the movable switch piece 3 clears the opening of the annular channel 20 towards the arc-quenching chamber 4, blow-out of the arc 5 starts as a result of the excess pressure built up previously in the storage chamber 9, which blow-out leads to a circulation flow (indicated by arrows in the FIGURE) around the dividing wall 14 and thus to an effective transport of energy into the storage chamber 9. In this connection, it is of advantage, in particular during the switching of low currents, that a high pressure of a comparatively cool and therefore rich insulating gas remains in the storage chamber 9 because of the intensive intermixing of hot and cold insulating gas for a long enough period beyond the current zero passage.

I claim:

1. Gas-blast switch having two switch pieces (2, 3), which are movable relative to one another along an axis in a housing (1), filled with insulating gas, and define an arc-quenching zone (4) during switch-off, an insulating body (8) defining the arc-quenching zone (4), a channel which is located in the insulating body (8) and connects the arc-quenching zone (4) with a storage chamber (9), and a compression device, the compression chamber (10) of which can be connected with the storage chamber (9), characterised in that the compression chamber (10) and the storage chamber (9) are connected to one another via a flow narrow point (18) which, during switch-off forms a free jet (19) of insulating gas, and that the flow narrow point (18) is aligned and arranged in such a way that a boundary surface (21) of the free jet (19) separates a first partial piece (16) of the channel, which partial piece (16) is connected with the arc-quenching zone (4), from a partial piece (17) connected with the storage chamber (9) and accomodating the free jet (19).

2. Gas-blast switch according to claim 1, characterised in that the channel is made with a bend, with the two partial pieces (16, 17) of the channel forming the legs of the bend.

3. Gas-blast switch according to claim 2, characterised in that the two partial pieces (16, 17) are located approximately perpendicular to one another.

4. Gas-blast switch according to claim 2, characterised in that the first partial piece (16) is extended approximately perpendicular to the switch piece axis and the second partial piece (17) is extended in an approximately axial direction.

5. Gas-blast switch according to claim 1, characterised in that the channel is made as an annular channel (15) and is defined by a dlviding wall (14) which at the same time defines the storage chamber (9) and a further annular channel (20) connecting the storage chamber (9) with the arc-quenching zone (4).

* * * * *